United States Patent [19]

Beer et al.

[11] Patent Number: 4,953,708

[45] Date of Patent: Sep. 4, 1990

[54] FLEXIBLE PACKAGE WITH POUR SPOUT AND HANDLE

[75] Inventors: Jeffrey S. Beer, Perkiomenville; Michael D. Gracie, Sr., Kennett Square; Tullio U. Vigano, Gwynedd Valley, all of Pa.

[73] Assignee: Fes-co System USA, Inc., Telford, Pa.

[21] Appl. No.: 398,204

[22] Filed: Aug. 23, 1989

[51] Int. Cl.[5] ..... B65B 33/10; B65B 33/20; B65B 33/22; B65B 33/38

[52] U.S. Cl. ..... 206/632; 206/631.2; 383/88; 383/17; 383/9

[58] Field of Search ..... 206/632, 631.1, 631.2; 383/906, 7, 9, 120, 88, 17

[56] References Cited

U.S. PATENT DOCUMENTS

| | | | |
|---|---|---|---|
| 819,056 | 5/1906 | Garber | 383/119 |
| 2,789,728 | 4/1957 | Britton | 206/632 X |
| 3,528,600 | 9/1970 | White | 383/9 |
| 3,642,189 | 2/1972 | Widenback | 383/7 |
| 4,332,344 | 6/1982 | Strodthoff | 383/906 X |
| 4,471,875 | 9/1984 | Hain et al. | 206/632 |
| 4,483,445 | 11/1984 | Lepisto et al. | 206/632 X |
| 4,518,087 | 5/1985 | Goglio | 206/632 |
| 4,603,537 | 8/1986 | Pace | 206/632 X |
| 4,786,190 | 11/1988 | Van Erden et al. | 206/632 X |
| 4,790,670 | 12/1988 | Barbaro | 206/632 X |

*Primary Examiner*—Paul T. Sewell
*Assistant Examiner*—Jacob K. Ackun, Jr.
*Attorney, Agent, or Firm*—Caesar, Rivise, Bernstein, Cohen & Pokotilow, Ltd.

[57] ABSTRACT

A flexible tubular package having a longitudinal axis and formed from flexible sheet material. The package comprising first and second panels disposed opposite each other and connected on laterally opposite sides. The upper end portion of the package terminates in a free edge and is folded over itself along a transverse fold line to form a flap with the portion of the first panel between the free edge and the fold line abutting the contiguous portion of the first panel below the fold line. The abutting portions are releasably secured to each other by adhesive. The flap includes at least one opening extending through the first and second panels to form a handle. A first permanent seal line extends transversely across the panels adjacent the fold line from one of the sides to an intermediate point, while a second peelable seal line extends transversely across the panels adjacent the fold line from the intermediate point to the other of the sides. The first seal line permanently seals the panels together, while the second seal line releasably seals them together. The flap is arranged to be unfolded to provide access to the second seal line, whereupon the second seal line can be peeled apart to form a pour spout for the package.

9 Claims, 2 Drawing Sheets

FIG. 1
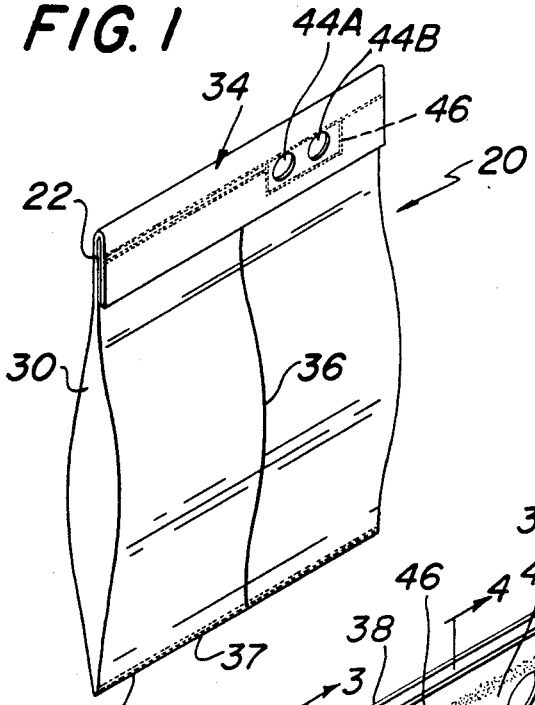
FIG. 3
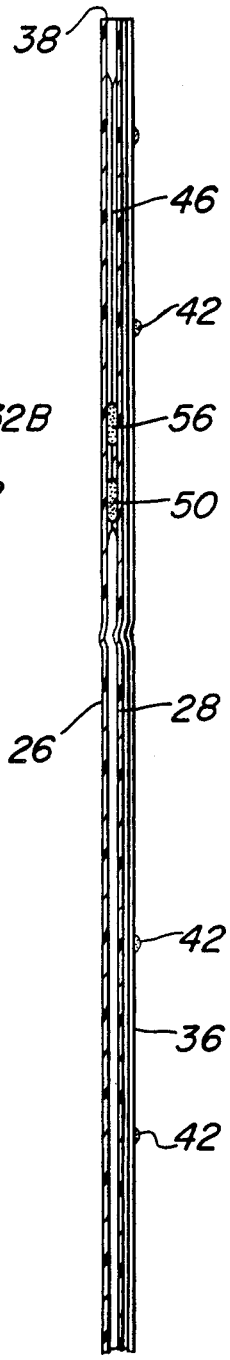
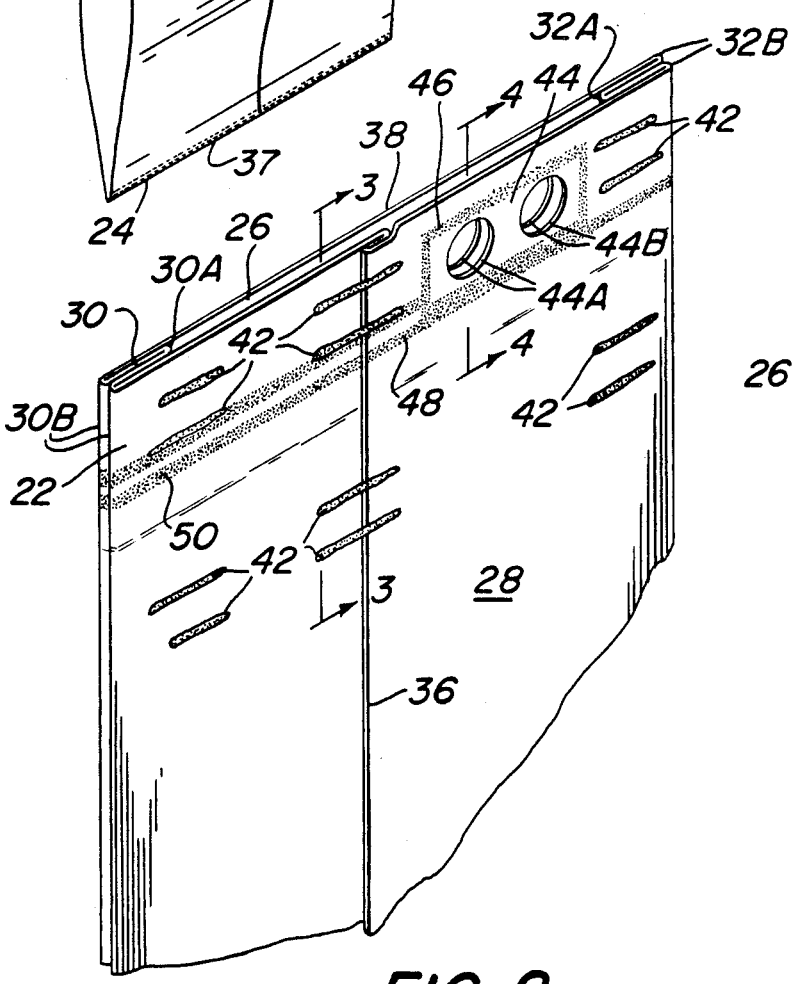
FIG. 2

FIG. 4
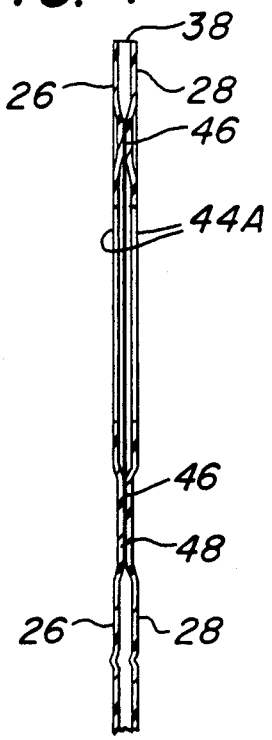
FIG. 6
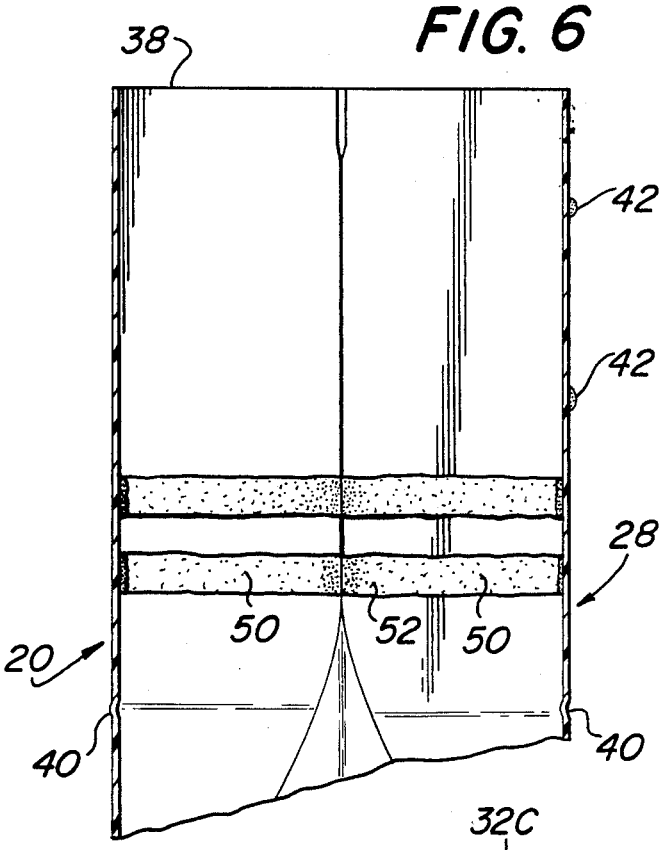
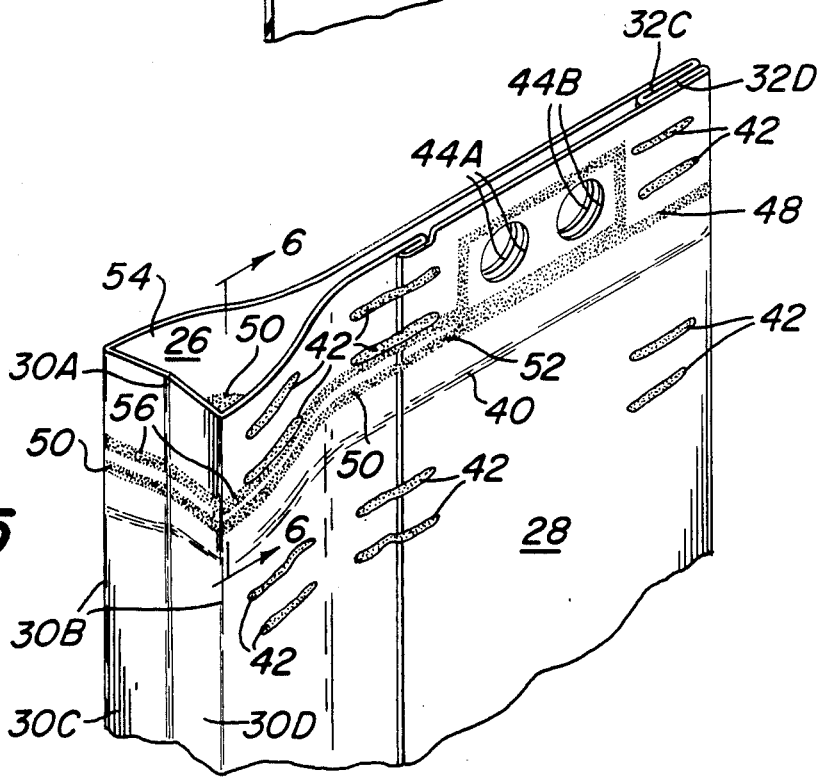
FIG. 5

FLEXIBLE PACKAGE WITH POUR SPOUT AND HANDLE

BACKGROUND OF THE INVENTION

This invention relates generally to packaging and more particularly to flexible packaging.

Flexible containers formed of sheet materials have gained wide acceptance in the trade for holding various products therein. Such packages commonly comprise one or more panels of flexible sheet material, e.g., polyethylene, polyvinylchloride, polyester, etc., which are heat sealed to each other to form a sealed chamber in which the packaged product is located. Some of such packages include means, e.g., perforated or weakened lines which may be torn or cut, to form a pour spout. Some packages also include means to form a handle for carrying the package. Examples of prior art flexible packages having a pour spout and a handle are found in U.S. Pats. Nos. 819,056 (Garber), 2,789,728 (Britton), 3,642,189 (Widenback), and 4,483,445 (Lepisto et al).

While the foregoing packages may be suitable for their intended purposes nevertheless they all appear to suffer from one or more drawbacks, such as complexity, difficulty to manufacture or fabricate, expense, necessity to tear or otherwise sever the package to form or open the pour spout.

OBJECTS OF THE INVENTION

Accordingly, it is a general object of this invention to provide flexible packaging which overcomes the disadvantages of the prior art.

It is a further object of this invention to provide a flexible package having a handle and a pour spout which is simple in construction and low in cost.

It is a further object of this invention to provide a flexible package which includes a handle for transporting it and a pour spout which can be readily opened without tearing, cutting or otherwise severing any portion of the package.

It is still a further object of this invention to provide a flexible package which includes a pour spout arranged to be readily peeled apart to provide access to the interior of said package but which pour spout is resistant to accidental opening.

SUMMARY OF THE INVENTION

These and other objects of this invention are achieved by providing a flexible tubular package having a longitudinal axis and formed from flexible sheet material. The package comprises first and second panels disposed opposite each other and connected on laterally opposite sides. The package has a sealed lower end portion and an upper end portion terminating in a free edge. The upper end portion of the package is folded over itself along a transverse fold line to form a flap, with the portion of the first panel between the free edge and the fold line abutting the contiguous portion of the first panel below the fold line. The abutting portions are releasably secured to each other by first releasably securable adhesive means interposed therebetween. The flap includes at least one opening extending through the first and second panels to form a handle. A first seal line extends transversely across the panels adjacent the fold line from one of the sides to an intermediate point. A second seal line extends transversely across the panels adjacent the fold line from the intermediate point to the other of the sides. The first seal line permanently seals the first and second panels together. The second seal line is peelable for releasably sealing the first and second panels together. The first releasably securable adhesive means is peelable to enable the flap to be unfolded to provide access to the second seal line, whereupon the second seal line can be peeled apart to form a pour spout for the package.

DESCRIPTION OF THE DRAWINGS

Other objects and many attendant features of this invention will become readily appreciated as the same becomes better understood by reference to the following detailed description when considered in connection with the accompanying drawings wherein:

FIG. 1 is a perspective view of the package of this invention shown in its sealed condition;

FIG. 2 is an enlarged perspective view of a portion of the package of FIG. 1 with its flap portion unfolded to provide access to its handle and pour spout;

FIG. 3 is an enlarged sectional view taken along line 3—3 of FIG. 2;

FIG. 4 is an enlarged sectional view taken along line 4—4 of FIG. 2;

FIG. 5 is an enlarged perspective view of a portion of the package of FIG. 1 with its pour spout open; and FIG. 6 is an enlarged sectional view taken along line 6—6 of FIG. 5.

DESCRIPTION OF THE PREFERRED EMBODIMENTS

Referring now to various figures of the drawing where like reference numerals refer to like parts there is shown at 20 in FIG. 1 one embodiment of the package of the subject invention. The package 20 is fabricated from a long strip of any suitable flexible sheet material, which is formed into a tube. The details of the construction of the package 20 and its method of formation will be described later. Suffice it for now to state that the package 20 is of the gussetted type having an upper end 22 portion and a lower end 24 portion. The package 20 is arranged to be filled with some product or material, e.g., a chemical composition, and then the package is sealed to enclose the contents of the package therein. The upper end portion includes a handle (to be described later) for carrying or otherwise transporting/supporting the package, and a pour spout (also to be described later) for enabling the package's contents (not shown) to be poured out in a controlled manner while the bag is supported by its handle.

As can be seen clearly in FIGS. 2 and 3 the package 20 basically comprises a front wall or panel 26, a rear wall or panel 28, a first side gusset fold 30, a second side gusset fold 32, the heretofore identified upper end 22, and the heretofore identified lower end 24. The upper end portion 22 is in the form of a foldable flap 34. This flap, whose construction will be described later, includes the heretofore mentioned handle and pour spout.

In accordance with a preferred embodiment of the invention a one-way venting valve (not shown) is mounted in one of the panels, e.g., the front panel 26, of the package. The valve enables gases which may be produced by the material(s) contained within the sealed package 20 to vent to the ambient air without any air gaining ingress to the package's interior.

As can be seen in FIGS. 2 and 5 the front panel 26, rear panel 28, and the two side gusset folds 30 and 32 of the package 20 are all integral portions of a single sheet or web of flexible material which has been folded and seamed to form a tubular body. Thus, the back panel 28 of the package 20 includes a longitudinally extending (vertical) seam 36. The seam is formed by the marginal edges of the sheet or web section which are brought into engagement with each other. Those edges are permanently secured to one another via any conventional sealing technique, such as heat sealing or welding. The lower end 24 of the package is also sealed closed along a permanent seam line 37 (FIG. 1). That seam line, as well as other seal lines (to be described later) is also formed using conventional sealing techniques, such as those used for seam 36.

The two side gusset folds 30 and 32 ar of identical construction. Thus, the same reference letters will be used on the corresponding components forming the gusset folds 30 and 32 To that end, as can be seen clearly in FIGS. 2 and 5 the gusset fold 30 comprises a central fold edge 30A interposed between a pair of outer fold edges 30B. The central fold edges and the outer fold edges all are parallel to the longitudinal axis of the package 20. In a similar manner the gusset fold 32 comprises a central fold edge 32A interposed between a pair of outer fold edges 32B. Two of outer fold edges 30B and 32B form the marginal edges of the front panel 26, while the other two of the outer fold edges 30B and 32B form the marginal edges of the rear panel 28. The pair of outer fold edges 30B define therebetween first and second gusset sections 30C and 30D, respectively. As can be seen the first and second gusset sections 30C and 30D are subadjacent, that is, lie under, the marginal edge portions of the front and rear panels 26 and 28, respectively. Similarly, the first and second gusset sections 32C and 32D are subadjacent the marginal edge portions of the front and rear panels 26 and 28, respectively.

The flap 34 basically comprises the upper portion 22 of the package's front panel 26, real panel 28, and gussetted folds 30 and 32 between the top marginal edge 38 thereof and a transverse fold line 40. When the package is sealed The flap is folded down along the transverse fold line 40 so that the outer surface of the rear panel 28 encompassed by the flap abuts the contiguous outer surface of the panel 28 below the fold line. The flap is held in place in this orientation by use of a releasably securable (e.g., peelable) adhesive interposed between the abutting surfaces of the panel 28. In the preferred embodiment of the invention shown herein the adhesive is a hot melt glue which is applied across the entire width of the package in plural aligned line segments 42.

The package's handle is designated by the reference numeral 44 and is in the form of a pair of finger holes or openings 44A and 44B in the panels 26 and 28 forming the flap 34 and located adjacent the top edge 38 and gusset fold 32. A rectangular heat seal 46 between the panels 26 and 28, encircles the openings 44A and 44B to serve as reinforcement means for the handle 44. That means deters the package from tearing or otherwise distorting at the handle when it is filled with heavy contents and supported by the handle.

The package, once filled with its contents, is sealed across its top portion 22 above the fold line 40 by a transverse heat seal line. The seal line extends the entire width of package and is made up of two sections 48 and 50 which are collinear. The heat seal line section 48 extends from the edges 32B of the gusset fold 32 to an intermediate point 52 to permanently seal the two panels 26 and 28 together, while also sealing the front panel 26 to the gusset section 32C, the rear panel 28 to the gusset section 32D, and the gusset sections 32C and 32D to each other. The heat seal line section 50 is a peelable seal line which extends from the edges 30B of the gusset fold 30 to the intermediate point 52 to releasably seal the two panels 26 and 28 together, while also releasably sealing the front panel 26 to the gusset section 30C, the rear panel 28 to the gusset section 30D, and the gusset sections 30C and 30D to each other. The panel portions 26 and 28 and the interposed gusset sections 30C and 30D within the boundary of the releasable seal section 50 defines the pour spout 54 of the package 20. The spout 54 is shown clearly in FIG. 5 and is created by the package's user peeling apart the panels 26 and 28 and the gusset sections 30C and 30D along the entire length of the seal line section 50.

In order to provide additional means to ensure that the spout 54 does not accidentally open the package 20 includes a second releasable seal line section 56 located immediately above seal line section 50. The seal line section 56 extends from the intermediate point 54 to the edges 30B and is virtually identical in construction and operation to seal line 50. The peelable heat seal line sections 50 and 56 may be formed by any suitable means, e.g., the teachings of U.S. Pat. No. 4,518,087 (Goglio) which is assigned to the same assignee as this invention and whose disclosure is incorporated herein.

As should be appreciated by those skilled in the art after the package 20 has been filled, its heat seals 48, 50, and 56 formed, its flap portion 34 folded down and adhesively secured via adhesive sections 42, the package is resistant to accidental opening. In this regard the folded and adhesively secured flap ensures that even if the peelable seal sections are broken or otherwise accidentally open, such as could conceivably occur with very rough handling, the package's contents cannot spill out since the flap will close off the spout. Thus, the package 20 of this invention can be used to safely store and/or transported materials, such as agricultural chemicals, without requiring very careful handling.

When it is desired to remove some of the package's contents all that is required is to peel the flap back, i.e., unfold it. This leaves the package in the condition shown in FIG. 2., thereby exposing the handle 46. The unfolding of the flap 34 also exposes or provides access to the package's peelable seal line sections 50 and 56. Thus, the panels 26 and 28 at these seal lines can be readily peeled apart to form the pour spout 54. The exposed finger holes 44A and 44B enable the package to be supported or held by placing ones fingers therethrough. The package may thus be easily supported and oriented to enable it's contents to be spilled out of the spout in a controlled manner by the user. If necessary, the package can be closed by refolding the flap 32 down onto the panel 28. Depending upon the type of adhesive 42 used the flap may or may not be held in place by that adhesive. Even if it isn't, the folded flap still provides some measure of protection against the contents spilling out of the spout.

It must be pointed out at this time that the single package 20 shown in the drawing may be manufactured (fabricated) as one of a large number of serially connected, identical packages. The serially connected packages may be rolled up and stored in a roll (not shown) until they are separated for filling. Thus, the lower end 24 of any one package 20 (except the last) of the roll of plural packages may be secured to the upper end 22 of the next succeeding package of the roll by a separation, e.g., perforated, line. Those separation lines are created during the package fabrication process in a conventional manner and thus will not be discussed in detail herein. Suffice it to state that when the packages are separated the separation lines form the upper and lower marginal edges of the package.

Without further elaboration, the forgoing will so fully illustrate our invention that others may, by applying current or future knowledge, readily adopt the same for use under various conditions of service.

We claim:

1. A flexible tubular package having a longitudinal axis and formed from flexible sheet material, said package comprising first and second panels disposed opposite each other and connected on laterally opposite sides thereof, said package having a sealed lower end portion and an upper end portion terminating in a free edge, said upper end portion of said package being folded over itself along a transverse fold line to form a flap with the portion of said first panel between said free edge and said fold line abutting the contiguous portion of said first panel below said fold line, said abutting portions being releasably secured to each other by first releasably securable adhesive means interposed therebetween, said flap including at least one opening extending through said first and second panels to form a handle for said package, a first seal line extending transversely across said panels adjacent said fold line from one of said sides to an intermediate point, a second seal line extending transversely across said panels adjacent said fold line from said intermediate point to the other of said sides, said first seal line permanently sealing said first and second panels together therealong, said second seal line being peelable for releasably sealing said first and second panels together therealong, said first releasably securable adhesive means being peelable to enable said flap to be unfolded to provide access to said second seal line, whereupon said second seal line can be peeled apart to form a pour spout for said package.

2. The flexible package of claim 1 wherein each of said sides is gussetted.

3. The flexible package of claim 1 additionally comprising a third seal line extending transversely across said panels adjacent said second seal line from said intermediate point to the other of said sides, said third seal line being peelable for releasably sealing said first and second panels together therealong.

4. The flexible package of claim 3 wherein each of said sides is gussetted.

5. The flexible package of claim 1 additionally comprising reinforcement means surrounding said opening.

6. The flexible package of claim 4 additionally comprising reinforcement means surrounding said opening.

7. The flexible package of claim wherein said material comprises a plastic.

8. The flexible package of claim 7 additionally comprising a third seal line extending transversely across said panels adjacent said second seal line from said intermediate point to the other of said sides, said third seal line being peelable for releasably sealing said first and second panels together therealong.

9. The flexible package of claim 8 wherein said first releasably securable adhesive means comprises a hot melt glue.

* * * * *